US005405069A

United States Patent [19]

Duncan et al.

[11] Patent Number: 5,405,069

[45] Date of Patent: Apr. 11, 1995

[54] PAPER MOTION DETECTION SYSTEM

[75] Inventors: Robert R. Duncan, Kingston; Robert A. Felix, Vestal, both of N.Y.

[73] Assignee: International Business Machines Corporation, Armonk, N.Y.

[21] Appl. No.: 185,274

[22] Filed: Jan. 24, 1994

Related U.S. Application Data

[63] Continuation of Ser. No. 840,871, Feb. 25, 1992, abandoned.

[51] Int. Cl.[6] ..... B65H 20/00

[52] U.S. Cl. ..... 226/25; 226/33; 226/45

[58] Field of Search ..... 226/24, 25, 27, 33, 226/45; 400/568, 582, 583, 636

[56] References Cited

U.S. PATENT DOCUMENTS

| | | | |
|---|---|---|---|
| 3,148,814 | 9/1964 | Studer | 226/2 |
| 3,659,081 | 4/1972 | Piccione | 226/25 X |
| 3,917,142 | 11/1975 | Guarderas | 226/38 |
| 3,949,856 | 4/1976 | Ulber et al. | 400/579 |
| 3,958,735 | 5/1976 | Wanat | 226/25 X |
| 4,091,913 | 5/1978 | Ku et al. | 400/124 |
| 4,100,420 | 7/1978 | Metcalf et al. | 250/561 |
| 4,137,528 | 1/1979 | Traise | 340/675 |
| 4,205,769 | 6/1980 | Blitchingten | 226/24 |
| 4,238,064 | 12/1980 | Plocik | 225/2 |
| 4,485,949 | 12/1984 | Gebhart et al. | 226/45 X |
| 4,488,670 | 12/1984 | Godshalk et al. | 226/24 X |
| 4,532,500 | 7/1985 | Henk | 226/25 X |
| 4,552,608 | 11/1985 | Hoffmann et al. | 226/27 X |
| 4,591,969 | 5/1986 | Bloom et al. | 400/583 X |
| 4,692,819 | 9/1987 | Steele | 226/27 X |
| 4,734,868 | 3/1988 | DeLacy | 400/583 X |
| 4,757,930 | 7/1988 | Ditto | 226/27 |
| 4,892,426 | 1/1990 | Steele | 400/708 |
| 5,027,993 | 7/1991 | Ferguson | 226/24 X |

FOREIGN PATENT DOCUMENTS

| | | | |
|---|---|---|---|
| 1-104555 | 4/1989 | Japan | 226/27 |
| 2149149 | 6/1985 | United Kingdom | 226/27 |

*Primary Examiner*—Daniel P. Stodola
*Assistant Examiner*—John P. Darling
*Attorney, Agent, or Firm*—Douglas M. Clarkson

[57] ABSTRACT

A motion detection system detects both a soft, or near, jam and a complete, or hard, jam in movement of a paper web. A first sensor generates signals in response to the web driver, and a second sensor generates signals that are responsive to actual web movement. The signals from the second sensor are connected to a register to exhibit a signal state, and the signals from the first sensor are totalled in a counter between a cycle of changes in the state of the signal in the register. If there is a significant deviation in this total, an "error" signal is generated to advance a counter. If the number of "error"s are counted above a preset number, a shut down signal is generated.

12 Claims, 2 Drawing Sheets

PAPER MOTION DETECTION SYSTEM

This is a continuation of Ser. No. 07/840,871, filed Feb. 25, 1991, now abandoned.

BACKGROUND OF THE INVENTION

1. Field of the Invention

This invention, generally, relates to arrangements for detecting the movement of paper in equipment that depends on the availability of paper for its successful operation and, more particularly, to a system for detecting abnormal motion in such paper movement.

Present day equipment use paper from either rolls or, more often, from a continuous supply of fan-fold paper, for either continuous movement or for intermittent movement in a stepped manner past an operating station. Examples of such equipment include printers used with computers, teletype machines, copiers, etc.

In such use, it is important to be able to detect any movement in the paper that is not as it should be, i.e., an abnormal movement in the paper. Most of the detection devices in use today depend upon a small wheel engaging the paper frictionally for rotating in order to develop paper movement signals.

However, it has been found that, while friction wheels are effective in many instances, there are situations where a friction wheel will turn but the paper is not moving in an acceptable manner.

Examples of such abnormal paper movement include paper flutter, where the web of paper vibrates and shakes due to various causes. Usually, a small sprocket wheel with pins engage matching holes along the length of a paper web to move the paper, and these holes can become improperly spaced, even absent altogether or the paper becomes torn.

Regardless of the cause of irregular or abnormal paper movement, a variation in the movement must be detected as soon as possible, and this detection should involve a decision as to whether the variation is a temporary variation in movement or a real paper jam.

Printers of the type used with computers usually use fan-fold paper that forms a continuous web which is moved intermittently in a step by step manner, and therefore, the paper web is moved by the distance of one or more lines for a printing head to execute a line of type at a time. When an undesirable condition is detected, a decision must be made quickly, simply and, preferably, automatically, whether or not to shut down the printer operation.

2. Description of the Prior Art

Prior devices sense paper movement because a friction wheel generates a signal that says there is paper movement, but it cannot say whether such movement is correct.

An example of the prior devices is U.S. Pat. No. 3,917,142 granted Nov. 4, 1975 to Guarderas that describes a monitoring arrangement using a friction wheel and a disc with slots to interrupt the optical path of light producing a pulse train to reset a counter after each paper feed command. When a paper jam occurs, no reset pulse is given to the counter, and after a number of counts, it generates a signal to terminate operations.

U.S. Pat. No. 3,949,856 to Ulber et al., granted Apr. 13, 1976, describes a system using two sources of signals, one source generates signals in response to movement of a paper feed wheel, and a second source generates signals in response to a friction wheel engaging the paper. The two signals are counted and compared, and if such comparison is not within expected limits, an indication is given.

While the prior systems at first appearance have similarities with the invention, they differ in material respects, and these differences will become more apparent as the description proceeds.

OBJECTS AND SUMMARY OF THE INVENTION

Accordingly, it is a principal object of the invention to provide a system to detect an abnormal movement in a web as well as a complete stop.

It is also an important object of the present invention to provide a web motion detection system that functions when even an abnormal movement occurs in a moving web to initiate a stop signal.

Briefly, a motion detection system for a web that is arranged according to the present invention includes a first sensor to generate signals responsive to movement of the web driving wheel and a second sensor to generate signals in response to actual movement of the web. The state of the signal from the second sensor starts a count of the number of signals from the first sensor, and these signals from the first sensor are totalled until a selected transition in the state of this signal occurs. A preset deviation from this total number of signals is counted, which count continues until a pre-established number is reached, at which point operation of the equipment to which the system of the invention is connected is terminated. At any time until this pre-established number is reached, if the preset deviation is not present, the counter is reset to begin counting the pre-established number again.

The above and other objects, features and advantages of the present invention will become more readily apparent from the following detailed description of the presently preferred embodiment.

BRIEF DESCRIPTION OF THE DRAWINGS

The present invention will be described with reference to the accompanying drawings, in which.

DETAILED DESCRIPTION OF THE INVENTION

Definitions

The following terms will be used in the description to follow, and therefore, the meaning identified opposite each term is intended to apply.

Emitters—These are the signals indicating that the motor shaft has rotated a predetermined amount.

Friction Wheel—This is a small, usually plastic, wheel that turns by frictional contact with the surface of a paper web. It is used to determine actual movement of the web. Slots or other openings in the friction wheel expose a sensor to a light, and the number and the spacing of the resulting signals, are used to indicate actual movement of the web.

Processor Controller—This is a microprocessor usually and is selected in accordance with the particular equipment using a web the motion of which is detected by the system of the invention.

Hard Jam—This identifies a condition where there is no movement of the web.

Soft Jam—This is a condition where there is some movement in the web, but the motion is abnormal as determined by pre-established parameters.

Figure 1:
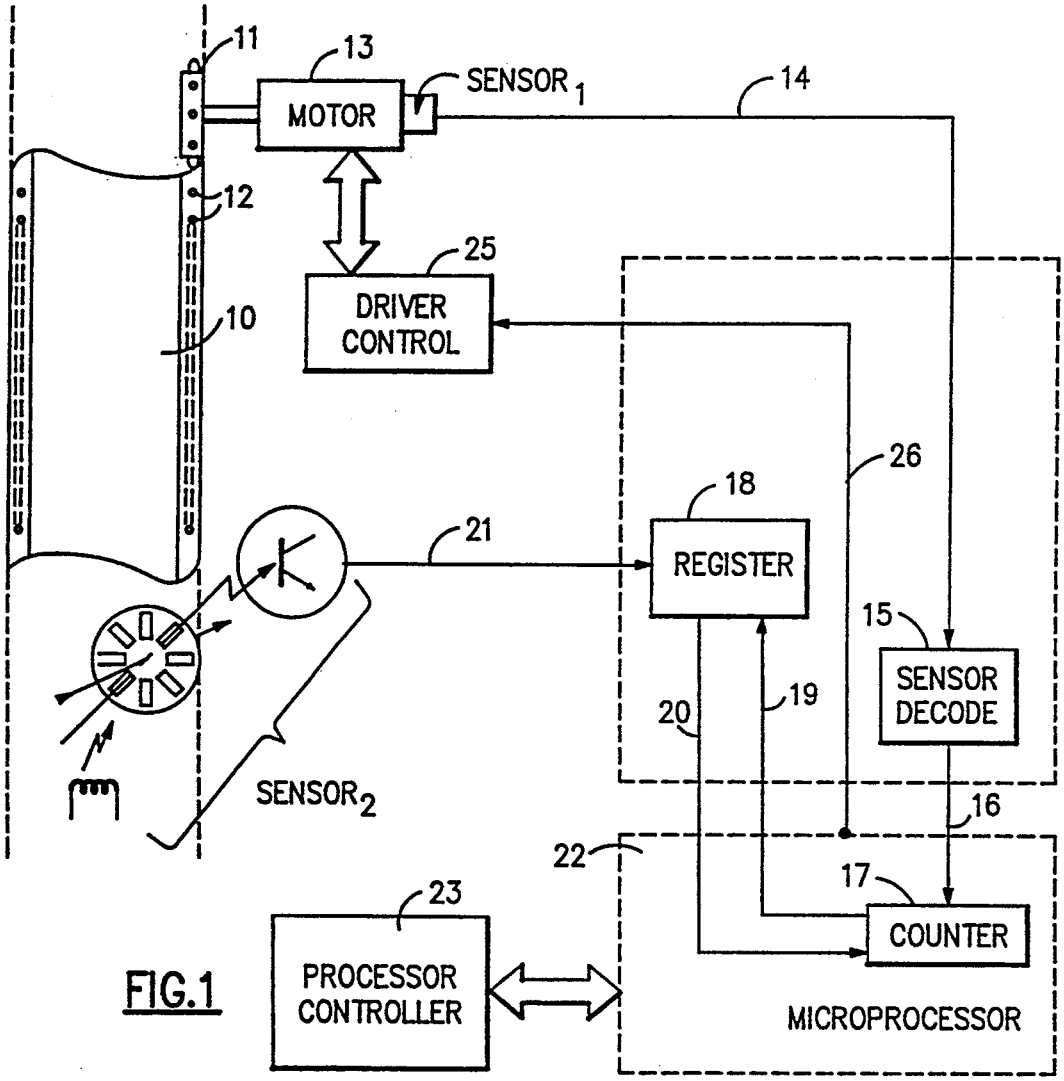
FIG. 1 is a block diagram illustrating the system as it is connected according to the invention.

In FIG. 1 of the drawings, an arrangement of a circuit is illustrated as an aid in describing the features and the advantages of the invention. A web 10 is shown as a part of a continuous supply of paper, whether from a roll, a sheet or fan-fold, for use in a printer that is connected with a computer. Of course, it will become clear that the invention can be adapted readily for use with other equipment and obtain its advantages, some of which will be identified in the description to follow.

The web 10 is moved by a sprocket wheel 11 with pins to engage holes 12 along the length of the web as the sprocket wheel is turned by a motor 13. A rotary disc is attached to the shaft of the motor 13 and is identified as $sensor_1$ for generating emitter signals responsive to movement of the shaft of the motor 13 and the sprocket wheel 11.

The emitter signals are connected by a line 14 to a sensor decode circuit 15 to produce emitter pulses on a line 16 for a counter 17. The emitter signals may contain more information than is needed for the arrangement of the invention, and so, the sensor decode circuit 15 generates one emitter pulse for each increment of web movement by the motor 13.

Each emitter pulse causes the state of the signal in a register 18 to be read over lines 19 and 20. For example, the register 18 is asked whether its signal, at that point in time, is at a "high" state or at a "low" state.

Alternatively, the state of the signal in the register 18 can be termed a "1" state or a "0" state, if desired. Since the contents of the register 18 are not latched, a reading, or an inquiry, will give the state of the signal at that point in time, i.e., which level the signal is, at that instant in time.

The signals in the register 18 are those generated by a $sensor_2$, which is a friction wheel and which generates signals over a line 21 as the web actually moves. In contrast, the signals generated by $sensor_1$ are usually continuous whether the web 10 actually moves or not.

Figure 2:
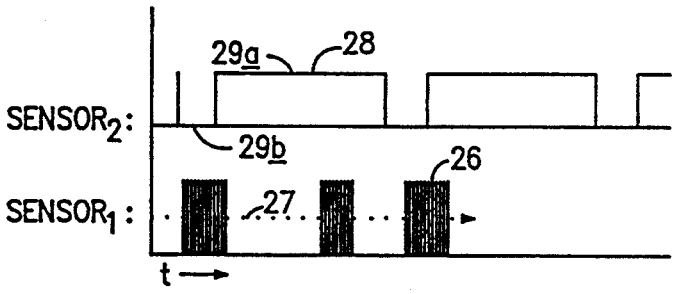
FIG. 2 is an illustration of the signals generated by the two sensors in the present invention.

FIG. 2 illustrates the signals from the sensors, $sensor_1$ and $sensor_2$, as they appear relative to each other. The pulses 26, in the particular arrangement described to illustrate the system of the invention, are 144 pulses per inch of linear movement of the web 10. The dotted arrow 27 indicates that these pulses 26 are substantially continuous along the time, or "x", axis of this figure.

The signals 28 illustrate the signals generated by the $sensor_2$ and are connected to the register 18 by the line 21. One state of the signal 28 is the level **29*a*, and the other state of this signal is the level 29*b***.

After the counter 17 is initiated and the state, or level, is established for the signal 28 in the register 18, the emitter pulses 26 on the line 16 cause the state of the signal in the register 18 to be examined for each pulse, and the counter 17 counts these emitter pulses. The counter 17 totals the number of emitter pulses received until the state of the signal in the register 18 changes and returns again to the now established state.

Upon a transition from one, now established, state to a different state, the number of pulses 26 that are totalled until this state changes and, then, returns to its now established state, develops a number that must be substantially the same during each such interval, or an "error" count is recorded by the counter 17.

Only after a predetermined number of such "error" conditions, such as 10 contiguous "error" counts, then a microprocessor circuit 22 receives a signal from the counter 17 indicating the situation, and the microprocessor circuit 22 initiates a "terminate operation" signal to the equipment processor controller 23 over a bus 24 and, also, to a driver control circuit 25 over a line 26. The driver control circuit 25 stops the motor 13, and no further signals will be generated by the $sensor_1$.

It will be evident that the counter 17 has two counting functions, but as the description proceeds, it will also be evident that these functions can be accomplished satisfactorily by a product identified by the number 8051, available commercially from the INTEL Corporation. The function performed by the counter 17 will be described more fully hereinafter.

If, during the accumulation of the "error" signal count in the counter 17, a correct count is observed before the predetermined number is reached, such correct count causes the counter 17 to be reset, so that it begins its count from zero. In other words, to obtain the full advantages of the system of the invention, a number of "error" signals should be determined, and they should be detected contiguously.

The reason a lower limit is preset to indicate that an "error" situation exists, between two successive state changes for the signal in the register 18, is that when a soft jam occurs, the web motion can be erratic, causing the time interval between successive signal state changes to be shortened. A shorter time interval will cause fewer emitter pulses to be counted between the signal state changes in the register 18.

When a hard jam situation occurs, the register 18 will not generate a signal state change, and the counter 17 continues to count. This situation develops when the web is not moving at all or it is moving very, very slowly.

In accordance with the invention, a high count limit should be preset and established for the counter 17, such as 245 or more. When this count is reached without a state change in the register 18, a "terminate operation" signal is generated, and it only takes one occurrence of this situation to stop the equipment.

The $sensor_1$ is attached to and driven from the shaft of the web drive motor 13 and generates a predetermined number of emitter signals as the motor rotates. For example, in one instance when the system of the invention is connected for operation with a printer used in connection with a computer, there is one emitter signal every 350 microseconds which generates one emitter pulse on the line 16 for each step of an intermittently stepped web 10. A step in this illustration is a motor shaft movement that causes the web 10 to move 1/144 inch.

On the other hand, the $sensor_2$ usually uses a photocell to generate a signal each time an opening in a friction wheel exposes a photocell to a light source. The signal generated is connected to the register 18 by the line 21 where its state, or level, can be read from the counter 17, as described previously.

The requirements for the counter 17 are somewhat complex, and therefore, they warrant repeating. For each emitter signal from the $sensor_1$, that signal is recorded and, at the same instant, the register 18 is asked for the state, or level, of the signal from the $sensor_2$.

The total number of emitter pulses recorded by the counter 17 since the previously established state of the signal in the register is compared with a preset number, and if it is the same or larger, the counter 17 does not record a count. But if the total number is less than the preset number, the counter 17 records an "error" and, only after recording a predetermined number of these "errors", such as at least 3 but preferably in the order of 10, the microprocessor 22 generates the "terminate operations" signal.

The counter 17 records two sets of numbers, one set is the number of emitter pulses, and the second set is the number of errors. Clearly, two counters can be used for this purpose, as mentioned previously, but the INTEL 8051 is capable of performing both of these functions satisfactorily. Other counters may be used, but it is the capability of functioning in the manner described that should govern.

For the particular use of the invention being described, i.e., with a printer, the web 10 is often in a continuous, fan-fold paper form that is stepped through the printer as it prints a line and, then, steps the paper to the next line. It is not unusual for these paper forms to slip partially or completely out of alignment with the pins in the sprocket wheel 11 due to several reasons, including improper loading of the paper supply, incorrect paper, and even a mistake in the printer setup.

There have been instances reported of the paper snagging on a rough edge in the paper feed tract and even getting caught on the side of the box from which the paper was being pulled. In most instances, the sprocket wheel 11 will keep turning, causing the sprocket pins to slip out of the holes along the edge of the paper or to tear the paper.

It is entirely possible, in an instance when using a heavy, multiple-sheet form, for a solid paper snag to cause the drive motor 13 to stall. The system of the invention is effective in functioning in this instance also.

Operation

Figures 3, 4:
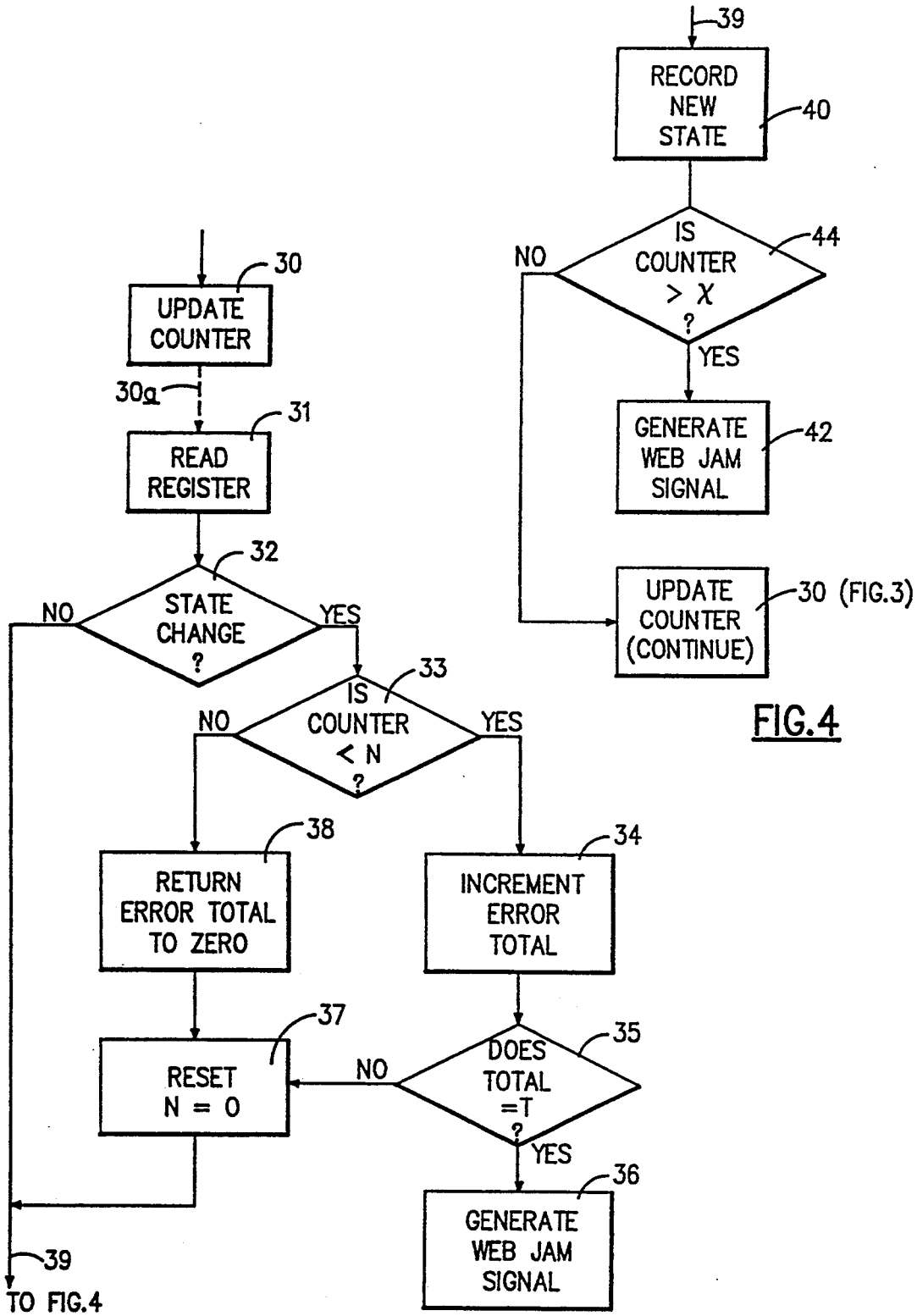
FIG. 3 illustrates the operation of the system of the invention in flow chart form.
FIG. 4 is a continuation in flow chart form of the operation of the system of the invention.

To describe the operation of the system of the invention in more detail, reference is made to FIG. 3, which shows a flow chart as an aid for the description. Using the circuit components described in connection with FIG. 1, an emitter signal from the $sensor_1$ will update the counter 17, as indicated by the block 30, in FIG. 3.

When each emitter pulse is received by the counter 17, the register 18 is interrogated as to the state of its signal at that moment. The state of the signal in the register 18 from the $sensor_2$ is available on line 20 upon an inquiry on line 19. This is indicated by the block 31, and the broken line **30*a*** shows this is a repeated action, occurring, in this arrangement, once for each emitter pulse.

Block 32 indicates the result of this inquiry. Assume that the answer to this inquiry is, "yes". There has been a change in the state of the signal in the register 18.

The block 33 illustrates a setup condition to which the system of the invention is readily adaptable. The system is preset to count the number of emitter signals received at the counter 17, and this is a number "N".

Therefore, for each selected change of state, block 32, the question to be asked is, "Does the number of emitter pulses equal, or is it less than, the preset number N?"Under these conditions, the "N" will depend on several variables, such as, is the web 10 moved in small steps or large steps. In this situation, the system of the invention will detect and respond to a "soft jam", or to a "near jam".

If the answer to the question asked in block 33 is, "Yes", the number of emitter pulses counted since the last state change in the register 18 is equal to or less than "N" by some permissible and allowable variation, the "error" count is increased. This condition is indicated by the block 34.

After each increase of the "error" count, the question, "Does the "error" total equal a preset total number T?", for example, "10". The block 35 illustrates this inquiry.

If an answer of, "Yes", is given, the system will cause a soft "Web Jam" signal to be generated, which is used to initiate any desired reaction, such as equipment shut down, an audible alarm or a visual alarm or any combination. This is indicated by the block 36.

On the other hand, if the answer to the inquiry in block 35 is, "No", the emitter pulse count is reset to zero as indicated by the block 37. An answer to the inquiry of the block 33 of, "No", will cause the "error" signal total count to be reset to zero, and this is indicated by block 38 which also causes the emitter pulse count, N, to be reset to zero, as illustrated by the block 37.

Whether it is the emitter count being reset to zero or the answer to the inquiry of the block 32 being, "No", the next step is shown in FIG. 4, by the line 39. A next or new state of the signal in the register 18 is recorded as the current state, indicated by the block 40.

A question now is asked whether the count is greater than a predetermined larger number "X", such as 245. This inquiry is indicated by the block 41. If the answer is, "Yes", the presence of a hard jam exists, and a web jam signal is generated, as illustrated by the block 42.

More frequently, the answer to the inquiry of block 41, whether the counter indicates a number greater than the predetermined number "X", is a, "No". Therefore, the consideration returns to the step indicated by block 30, continue the update of the counter by the next emitter pulse.

It will be understood readily from the above description that other and different equipment can be used with the system of the invention, and the above described system can be modified and changed to accommodate various operating conditions, situations and requirements.

Having presented hereinabove and in the accompanying drawings a complete description of the presently preferred embodiment of the invention, it will be apparent to those skilled in this art that modifications and changes can be made, but it is understood that all such modifications and changes that come within the spirit and scope of the appended claims are within the present invention.

We claim:

1. A motion detection system to detect both abnormal movement and a complete absence of movement of a continuous, fan-fold paper web in a printer apparatus, comprising:

web moving means including means to engage said paper web in a positive web moving manner for intermittent movement of said paper web in predetermined increments;

first sensor means connected with said web moving means for generating predetermined signals responsive to movement of said web moving means;

second sensor means for generating predetermined signals responsive to movement of said paper web;

circuit means connected to exhibit a predetermined characteristic in response to signals generated by said second sensor means;

counter means connected to count the number of signals generated by said first sensor means in response to a predetermined change in said characteristic exhibited by said circuit means, and including means to generate a signal in response to said count reaching a predetermined number; and microprocessor means to generate a signal in response to a predetermined count by said counter means.

2. A motion detection system as defined by claim 1 wherein said counter means includes means to count said emitter signals between alternate state changes.

3. A motion detection system as defined by claim 1 wherein said predetermined number is in the order of 10.

4. A motion detection system as defined by claim 1 wherein said predetermined characteristic exhibited by said circuit means is a state of said signals generated by said second sensor means.

5. A motion detection system as defined by claim 1 wherein said predetermined change in said characteristic exhibited by said circuit means includes a change in state.

6. A motion detection system as defined by claim 1 wherein said counter means includes means to total the number of times said count reaches a predetermined value.

7. A motion detection system as defined by claim 1 wherein said counter means includes means to total the number of times said count reaches a predetermined value, and includes means to return said total to a predetermined value when said count is a predetermined amount.

8. A motion detection system as defined by claim 1 wherein said predetermined characteristic exhibited by said circuit means is a state of said signals generated by said second sensor means, and said predetermined change in said characteristic includes a change in said state.

9. A motion detection system as defined by claim 1 wherein said counter means includes means to total the number of times said count reaches a predetermined value.

10. A motion detection system as defined by claim 1 wherein said counter means includes means to total the number of times a predetermined value is reached, and including means to return said total to a preset value when said count is a predetermined amount.

11. A motion detection system as defined by claim 1 wherein said predetermined characteristic exhibited by said circuit means is a state of said signals generated by said second sensor means, said predetermined change includes a change in state, said counter means includes means to total the number of times said count reaches a predetermined value.

12. The motion detection system as defined by claim 1 wherein said first sensor means is connected to be responsive to said web moving means, and said second sensor means is in the form of a friction wheel in engagement with the web.

* * * * *